US006204619B1

(12) United States Patent
Gu et al.

(10) Patent No.: US 6,204,619 B1
(45) Date of Patent: Mar. 20, 2001

(54) DYNAMIC CONTROL ALGORITHM AND PROGRAM FOR POWER-ASSISTED LIFT DEVICE

(75) Inventors: Edward Y. L. Gu; Leo Paul Gerard Oriet, both of Rochester Hills, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/412,188

(22) Filed: Oct. 4, 1999

(51) Int. Cl.[7] ..... B66F 9/00

(52) U.S. Cl. ..... 318/568.11; 318/568.21; 318/646; 254/1; 901/50

(58) Field of Search ..... 318/567, 568.1, 318/568.11, 568.2, 568.21, 568.22, 646; 254/1, 33, 45, 264; 901/50

(56) References Cited

U.S. PATENT DOCUMENTS 3,628,505 * 12/1971 Myers .
3,904,042 * 9/1975 Colston .
3,940,110 * 2/1976 Motoda ..... 254/168
5,739,811 * 4/1998 Rosenberg et al. ..... 345/161
5,742,138 4/1998 Kato et al. ..... 318/568.18
5,865,426 2/1999 Kazerooni ..... 254/270
5,915,673 * 6/1999 Kazerooni ..... 254/270
6,084,371 * 7/2000 Kress et al. ..... 318/566

* cited by examiner

*Primary Examiner*—Bentsu Ro
(74) *Attorney, Agent, or Firm*—Roland A. Fuller, III

(57) ABSTRACT

A dynamic control system for a power-assist device has a statics formulator for determining a set of static torques for the lift system based on force data from the lift system. The control system further includes a dynamics formulator for determining a set of dynamic torques for the lift system based on joint data and the static torques. A static torque and a dynamic torque is therefore determined for each joint of the assist device. The control system also includes a torque summation module for summing the dynamic torques with the static torques to determine torque data for each joint of the lift system. The torque summation module applies the torque data to the lift system to achieve dynamic compensation within a substantially shorter response time. Thus, a method and system are presented for dynamically controlling a power-assisted lift system to continuously reduce human operator strain in a real-time mode.

20 Claims, 4 Drawing Sheets

DYNAMIC CONTROL ALGORITHM AND PROGRAM FOR POWER-ASSISTED LIFT DEVICE

BACKGROUND OF THE INVENTION

1. Field of the Invention

The present invention relates generally to power-assist devices. More particularly, the present invention relates to a method and system for dynamically controlling a power-assisted lift system to continuously reduce operator strain in a real-time mode.

2. Discussion of the Related Art

In the automotive industry, lift devices are often employed in car assembly line stations to assist human operators with difficult tasks. These devices are most useful in stations requiring the lifting and manipulation of heavy loads. A typical device is primarily designed to balance the gravity of a load during lifting and travel around an assembly line station. The human operator, however, must still push or pull the device in order to move it horizontally for parts assembling. These actions require the operator to either accelerate or decelerate the load-carrying device each time a change in direction is desired. This directional change is particularly difficult when each major link of the device is large in mass and has significant moments of inertia which add to the amount of work to be done. To further aggravate the problem, a typical operation in a car assembly line will often be repeated in excess of 50 times per shift. This repetition has the potential to cause cumulative wrist or arm injury after consecutive months of work. Power-assisted lift devices were therefore developed to address the major concerns of ergonomics and human factors engineering.

Typical power-assisted approaches provide lift devices with four-axis motion. These devices are driven by servomotors and guided by a closed-loop feedback of force data. In one system manufactured by FANUC Robotics, Inc., the force data are monitored and measured by a six-axis force sensor mounted behind the manual handle of the device. The current status of the feedback loop, however, is based only on the kinematics/statics relation between Cartesian positions/forces and joint positions/torques of the device. Thus, these systems have a noticeably slow response to operator-induced changes in direction. The slow response results in significant strain on operators any time a change in direction is attempted. It is therefore desirable to use joint data to provide a dynamic compensation within a substantially shorter response time.

SUMMARY OF THE INVENTION

The present invention provides a power-assisted lift system for assisting a human operator in manipulating objects. The lift system has a power-assist device that generates and measures joint data. The lift system also has a sensing module for converting a human-applied force into force data. The lift system further includes a dynamic control system for continuously reducing operator strain in a real-time mode based on the force data and the joint data.

The present invention also provides a dynamic control system for continuously reducing strain on a human operator of the power-assisted lift system, wherein the lift system has a plurality of joints. The control system has a statics formulator for determining a set of static torques for the lift system based on force data and joint data of the power-assist device. The control system further includes a dynamics formulator for determining a dynamic torque required for each joint of the power-assist device based on the joint data and static torques. The control system also includes a torque summation module for summing the dynamic torques with the static torques to determine torque data for each joint of the power-assist device. The torque summation module applies the torque data to the power-assist device to dynamically compensate human operation.

As an additional feature, the invention includes a computer implemented method for controlling a power-assist device. The method includes the step of retrieving force data from the power-assist device. The force data results from human operation of the power-assist device. The method further includes the step of retrieving joint data from the power-assist device. The method then compensates the human operation of the power-assist device based on the force data and the joint data.

Further objects, features and advantages of the invention will become apparent from a consideration of the following description and the appended claims when taken in connection with the accompanying drawings.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

Figure 1:
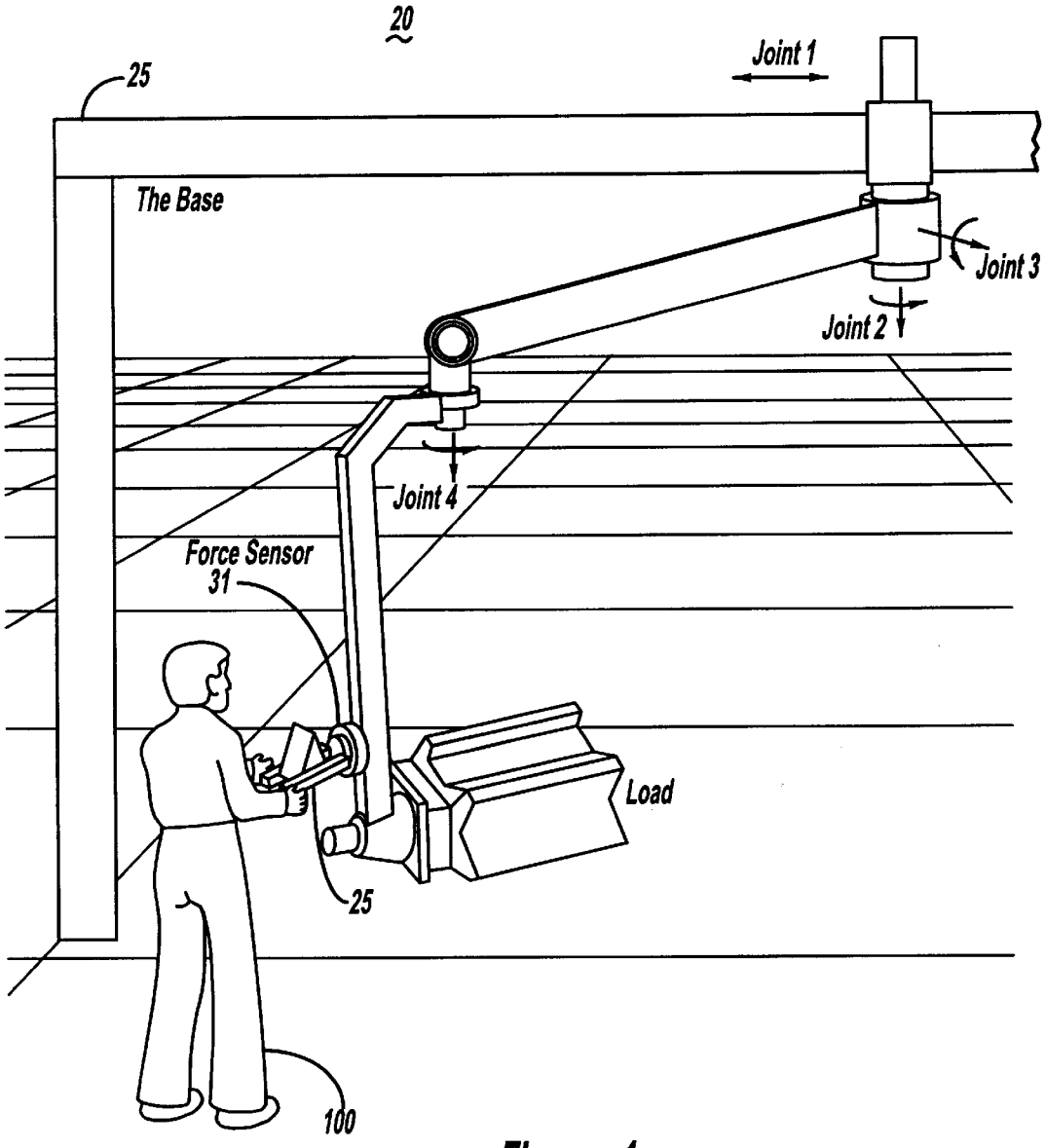
FIG. 1 is an illustration of a power-assist device in accordance with the present invention.
Figure 2:
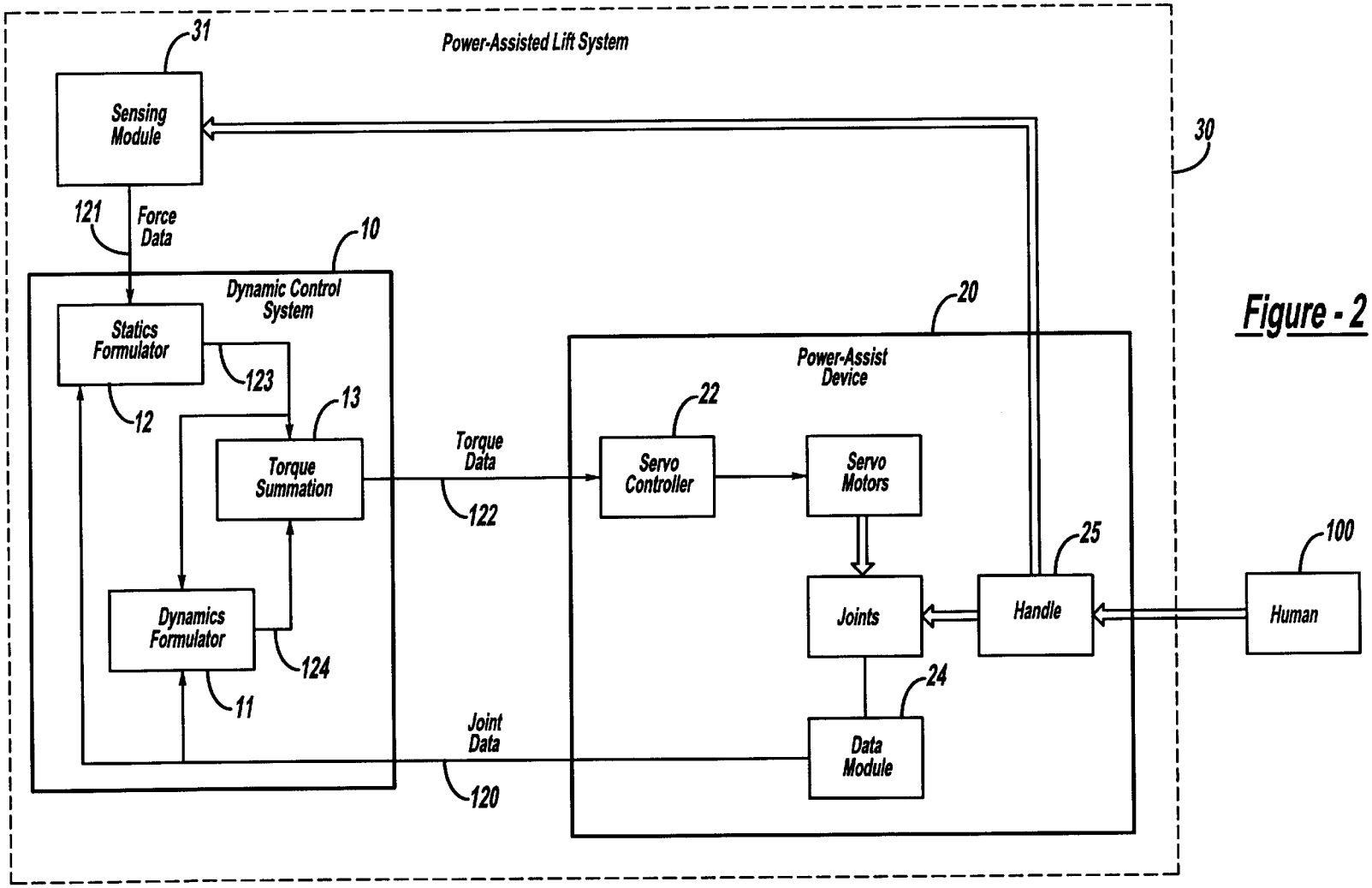
FIG. 2 is a block diagram of a power-assisted lift system using a dynamic control system in accordance with the present invention.

FIG. 1 is an illustration of a power-assist device 20 in accordance with the present invention. The present invention directed toward a dynamic control system for continuously reducing operator strain during operation of power-assist device 20 is best shown in FIG. 2 at 10. Generally, a power-assisted lift system 30 includes a power-assist device 20, a sensing module 31, and a dynamic control system 10 which can be readily implemented in robotic control systems commonly known in the art. Control for the lift system 30 is completely dynamic.

As shown in FIGS. 1 and 2, the power-assist device 20 aids the human operator 100 in manipulating objects of significant weight. It will be appreciated that the assist device 20 generates joint data 120 while the sensing module 31 converts forces resulting from human operation into force data 121. The dynamic control system 10 uses the force data 121 and the joint data 120 to continuously reduce strain on the human operator 100 in a real-time mode via torque data 122.

Specifically, the assist device 20 has a joint-servo controller 22 for converting torque data 122 from the dynamic control system 10 into motor control data. The assist device 20 has a plurality of joints and a servo motor manipulating each joint based on the motor control data. In the preferred embodiment, assist device 20 has four joints and is anchored to base 25. The motor control data is fed to the servo motors, and each servo motor in turn operates a corresponding joint. Operation of the joints reduces the amount of strain felt by the operator 100. The assist device 20 also has a joint data module 24 for generating joint data, wherein the joint data 120 includes joint position, joint velocity and computed joint acceleration. Joint accelerations are computed from the joint velocities and partial derivative inertial matrix to be described below. The joint data module 24 includes a joint encoder and a tachometer for monitoring, measuring, and retrieving the joint data 120 from the joints.

The assist device 20 performs several important functions such as relaying the applied force from the human operator 100 to the sensing module 31 via handle 25. The assist device 20 also provides joint data 120 from each joint to the dynamic control system 10 for dynamic compensation purposes.

Preferably, the sensing module 31 includes a six-axis force sensor coupled to a steering handle 25 of the lift device 21.

The dynamic control system 10 includes a statics formulator 12 for determining a set of static torques 123 based on force data 121. Dynamic control system 10 further includes a dynamics formulator 11 for determining a set of dynamic torques 124 based on the joint data 120 and the static torques 123 as adapted by a compensation module discussed in greater detail below. An individual static torque and dynamic torque is determined for each joint in the power-assist device 20. The dynamic control system 10 also has a torque summation module 13 for summing the dynamic torques 124 the static torques 123 to determine torque data 122 for each joint. The torque summation module 13 applies the torque data 122 to the lift system 20, and the lift system 20 applies the torque data to the servo motors to continuously reduce strain on the human operator 100 in a real-time mode.

Figure 3:
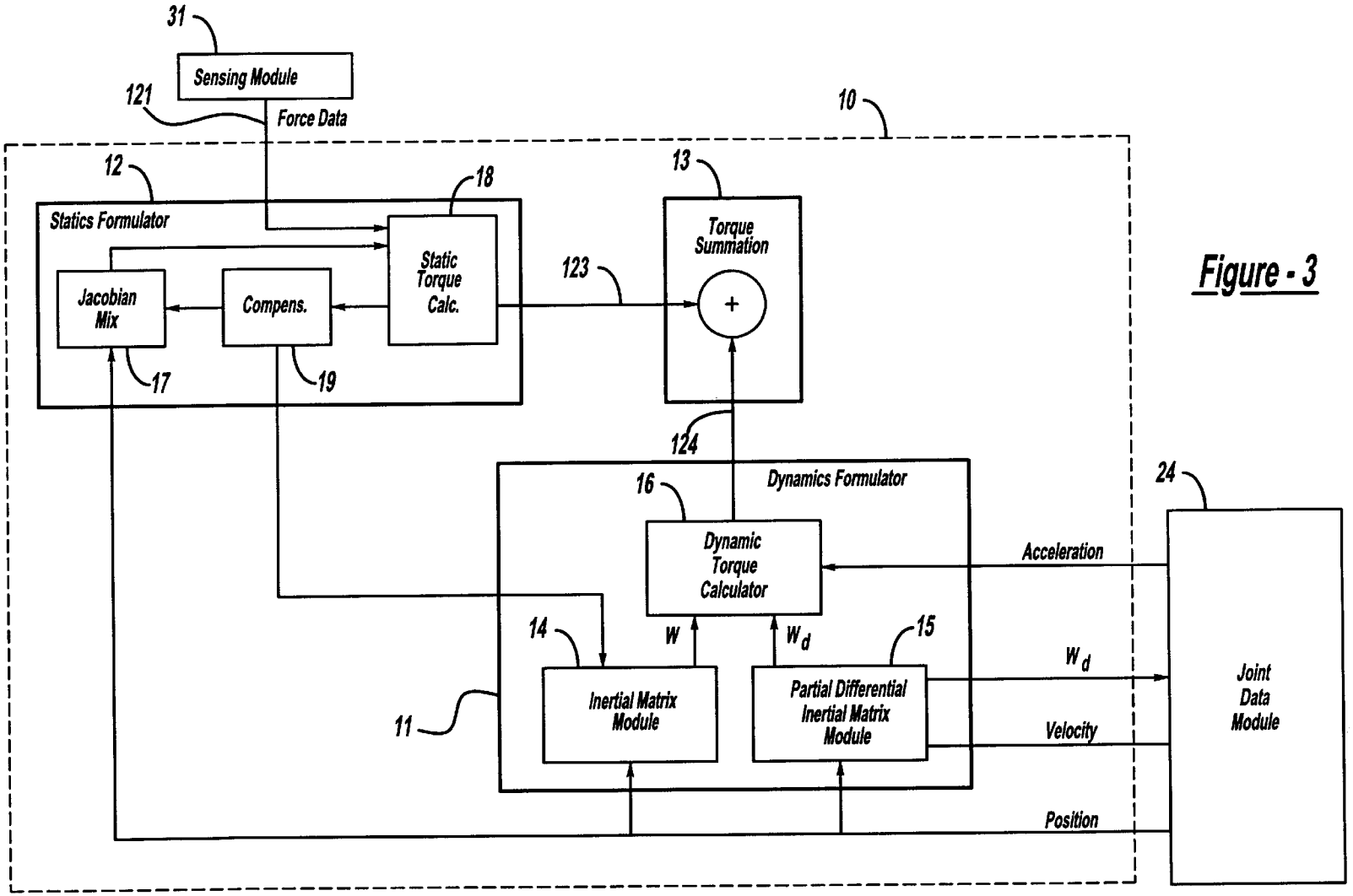
FIG. 3 is a detailed block diagram of an power-assisted lift system using a dynamic control system in accordance with the present invention.

Turning now to FIG. 3, the dynamic control system 10 is shown in greater detail. It will be appreciated that the dynamics formulator 11 includes an inertial matrix module 14 for modeling the inertial matrix W of the assist device. The dynamics formulator 11 further includes a partial differential inertial matrix module 15 for modeling a partial derivative of the inertial matrix $W_d$ of the assist device 20. A dynamic torque calculator 16 then calculates the dynamic torques 124 from the joint accelerations, the inertial matrix W, and the partial differential inertial matrix $W_d$. A compensator module 19 is included within the statics formulator 12. Compensator module 19 uses the static torques 123 to further adapt the inertial matrix W and the Jacobian matrix. Modeling both the Jacobian matrix and the inertial matrix begins with knowledge of certain kinematic parameters. The Denavit-Hartenberg (D-H) kinematic parameter table of a power-assisted lift device is determined as follows:

| Joint Variable | Joint Angle $\theta i$ | Joint Offset $d_i$ | Twist Angle $\alpha_i$ | Link Length $a_i$ |
|---|---|---|---|---|
| $d_1$ | $\theta_1 = -90°$ | $d_1$ | 90° | $-a_1$ |
| $\theta_2$ | $\theta_2$ | $d_2$ | 90° | 0 |
| $\theta_3$ | $\theta_3$ | 0 | 0 | $a_3$ |
| No Var. | $\theta_4 = -\theta_3$ | 0 | −90° | 0 |
| $\theta_5$ | $\theta_5$ | $d_5$ | −90° | 0 |
| No Var. | $\theta_6 = 90°$ | $d_6$ | 0 | 0 |

For the dynamic model, the inertial matrix W is developed as follows:

$$W = \begin{pmatrix} w_{11} & w_{21} & w_{31} & W_{51} \\ w_{21} & w_{22} & w_{32} & w_{52} \\ w_{31} & w_{32} & w_{33} & w_{53} \\ w_{51} & w_{52} & w_{53} & w_{55} \end{pmatrix}$$

where and hereafter $$\begin{cases} w_{11} = m_1 + m_2 + m_3 + m_4 + m_5, \\ w_{22} = m_3 l_3^2 c_3^2 + m_4 a_3^2 c_3^2 + m_5 (b_5 + a_3 c_3 s_5)^2 + m_5 a_3^2 c_3^2 c_5^2 + I_{z2} + I_{y3} + I_{y5}, \\ w_{33} = m_3 l_3^2 + m_4 a_3^2 c_3^2 + m_5 a_3^2 c_3^2 + I_{z3} + I_{z4}, \\ w_{55} = m_5 b_5^2 + I_{y5}, \\ w_{21} = -m_3 l_3 c_2 c_3 - m_4 a_3 c_2 c_3 + m_5 (b_5 + a_3 c_3 s_5) s_{25} + m_5 a_3 c_3 c_5 c_{25}, \\ w_{31} = -m_3 l_3 s_2 s_3, \\ w_{32} = 0, \\ w_{51} = m_5 b_5 s_{25} \\ w_{52} = m_5 b_5 (b_5 + a_3 c_3 s_5) + I_{y5}, \\ w_{53} = 0. \end{cases}$$

$s_i = \sin\theta_i$, $c_i = \cos\theta i$ for $i = 2,3,5$ and $s_{25} = \sin(\theta_2 + \theta_5)$ and $c_{25} = \cos(\theta_2 + \theta_5)$.

The Dynamics Formulation is based on $$\tau_d = W\ddot{q} + (W_d^T - \tfrac{1}{2} W_d)\dot{q} + \tau_g,$$

where $\tau_g = -\partial P/\partial q$ is the joint torque due to gravity, and $$W_d = \begin{pmatrix} \dot{q}^T \dfrac{\partial W}{\partial_{q_1}} \\ \vdots \\ \dot{q}^T \dfrac{\partial W}{\partial_{q_4}} \end{pmatrix}.$$

Once again, it is important to note that the joint data 120 includes information such as joint position, joint velocity, and the computed joint acceleration for each joint in the assist device 20.

The statics formulator 12 includes a Jacobian matrix module 17 for modeling the Jacobian matrix for the assist device 20. The statics formulator 12 also includes a static torque calculator 18 for calculating the static torques 123 from the Jacobian matrix and the measured Cartesian force.

The Jacobian matrix is found to be $$J = \begin{pmatrix} 0 & 0 & -a_3 c_3 & 0 \\ 0 & a_3 s_2 c_3 + d_6 c_{25} & a_3 c_{2s} s_3 & d_6 c_{25} \\ 1 & a_3 c_2 c_3 - d_6 s_{25} & -a_3 s_{2s} s_3 & -d_6 s_{25} \\ 0 & 1 & 0 & 1 \end{pmatrix}.$$

This is based on the joint position vector defined by $q = (d_1 \theta_2 \theta_3 \theta_5)^T$ and the output $$\begin{cases} x = -d_2 - a_3 s_3 - d_5 \\ y = a_1 - a_3 c_2 c_3 + d_6 s_{25} \end{cases}$$

-continued $$\begin{cases} z = d_1 + a_3 s_2 c_3 + d_6 c_{25} \\ \phi = \theta_2 + \theta_5. \end{cases}$$

The Statics Formulation is $$\tau_s = J^T F.$$

Figure 4:
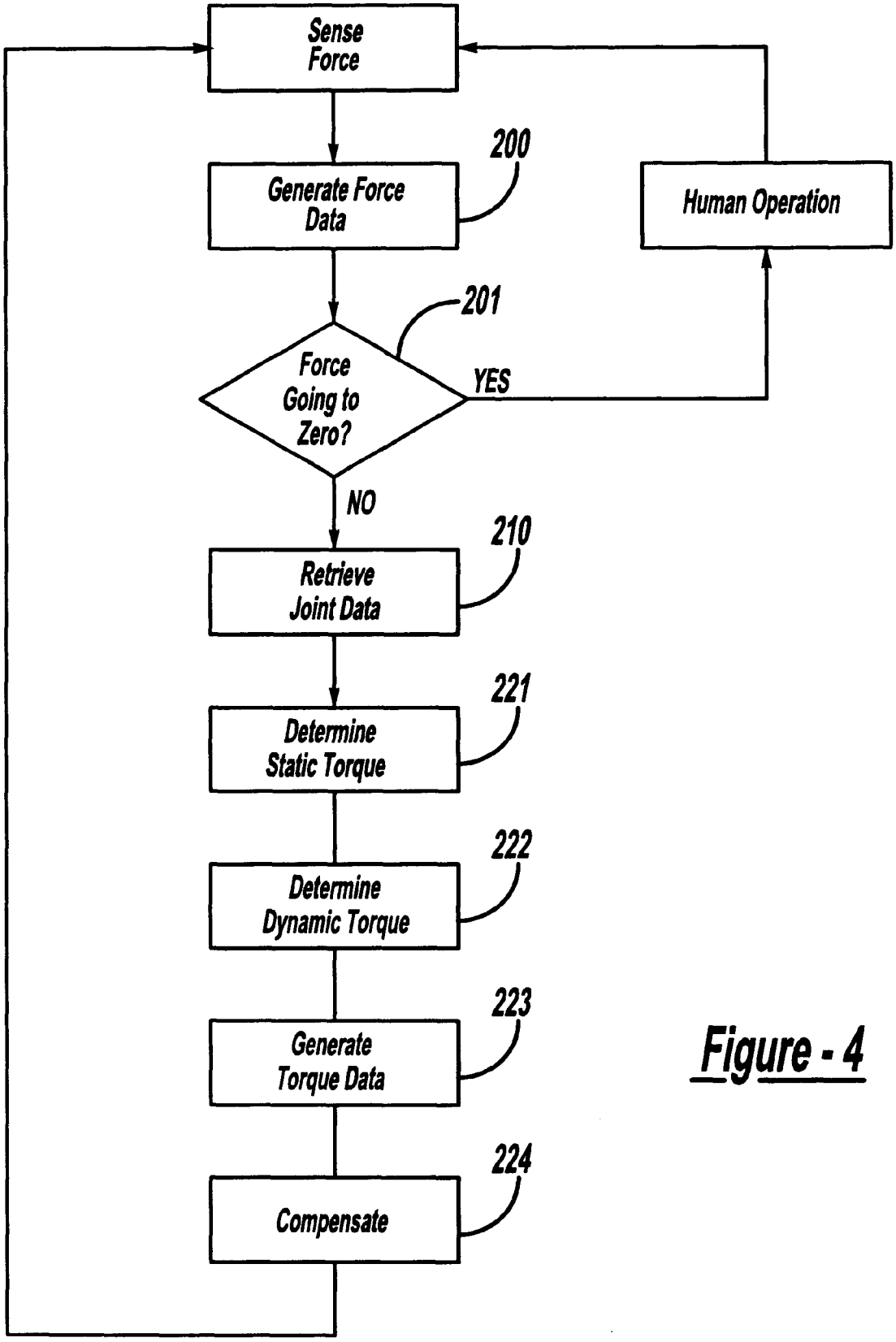
FIG. 4 is a flowchart of a computer-implemented method for controlling a power-assisted lift system in accordance with the present invention.

Returning to FIGS. 1 and 2, it can be seen that in operation a human operator 100 manipulates the power-assist device 20 via handle 25. The present invention envisions a computer-implemented method for controlling the power-assist device 20 as shown in FIG. 4 for programming purposes. The method includes the steps 200 and 210 of obtaining force data 121 and joint data 120 from the assist device 20. The method further includes the step 224 of compensating human operation of the assist device based on the force data 121 and joint data 120. A decisional loop is provided at step 201 to determine whether the force is going to zero. Compensation effectively involves the cancellation of human input along any combination of six axes. The relevant axes are the standard X,Y and Z Cartesian forces as well as torque about each axis. As the operator 100 applies various forces to the handle 25, the present invention performs the above calculations to minimize strain of the operator 100. Thus, the method includes the steps 221, 222, and 223 of determining static torque, determining dynamic torque, and generating torque data, respectively.

It is to be understood that the invention is not limited to the exact construction illustrated and described above, but that various changes and modifications may be made without departing from the spirit and the scope of the invention as defined in the following claims.

What is claimed is:

1. A dynamic control system for continuously reducing strain on a human operator of a power-assisted lift system, the lift system having a plurality of joints, said control system comprising:

a statics formulator for determining a set of static torques for said lift system based on force data and joint data from said lift system;

a dynamics formulator for determining a set of dynamic torques for said lift system based on said joint data and said static torques; and a torque summation module for summing said dynamic torques with said static torques to determine torque data for each joint of said lift system, said lift system using said torque data to control each joint of said lift system such that strain is reduced on the human operator.

2. The control system of claim 1 wherein said joint data comprises joint position, joint velocity, and joint acceleration for each joint in said lift system.

3. The control system of claim 1 wherein said dynamics formulator comprises:

an inertial matrix module for modeling an inertial matrix of said lift system;

a partial differential inertial matrix module for modeling a partial differential inertial matrix of the lift system; and a dynamic torque calculator for calculating said dynamic torques from said joint data, said inertial matrix, and said partial differential inertial matrix.

4. The control system of claim 3 wherein said inertial matrix module models said inertial matrix based on joint position data and compensated static torques.

5. The control system of claim 3 wherein said partial differential inertial matrix module models said partial differential inertial matrix based on joint position data and joint velocity data.

6. The control system of claim 1 wherein said statics formulator comprises:

a Jacobian matrix module for modeling a Jacobian matrix for said lift system;

a compensator module for adapting an inertial matrix and the Jacobian matrix; and a static torque calculator for calculating said static torques from said Jacobian matrix and said force data.

7. A power-assisted lift system comprising:

a power-assist device for assisting a human operator in manipulating objects, said assist device generating joint data;

a sensing module for converting a force into force data, said force applied to said power-assist device by said human operator; and a dynamic control system for continuously reducing operator strain in a real-time mode based on said force data and said joint data.

8. The lift system of claim 7 wherein said dynamic control system comprises:

a statics formulator for determining a set of static torques for said assist device based on said force data and said joint data;

a dynamics formulator for determining a set of dynamic torques for said assist device based on said joint data and said static torques; and a torque summation module for summing said dynamic torques with said static torques to determine torque data for each joint of said assist device, said lift system using said torque data to continuously reduce strain on said human operator in a real-time mode.

9. The lift system of claim 7 wherein said assist device includes a joint data module and said joint data comprises joint position, joint velocity, and joint acceleration for each joint in said assist device.

10. The lift system of claim 9 wherein said joint data module calculates said joint acceleration based on said joint velocity and a partial derivative inertial matrix for said lift system.

11. The lift system of claim 10 wherein said joint data module includes a joint encoder and a tachometer at each joint of said assist device.

12. The lift system of claim 7 wherein said assist device comprises:

a joint-servo controller for converting joint torque data from said dynamic control system into motor control data;

a plurality of joints; and a servo motor manipulating each said joint based on said motor control data.

13. The lift system of claim 7 wherein said sensing module comprises a six-axis force sensor coupled to a steering handle of said lift system.

14. A computer implemented method for controlling a power-assist device, the assist device having a plurality of joints, the method comprising the steps of:

retrieving force data from said assist device, said force data resulting from human operation of said assist device;

retrieving joint data from said assist device; and compensating said human operation of said assist device based on said force data and said joint data.

15. The method of claim 14 further comprising the steps of:

determining a set of static torques for said assist device based on said force data and said joint data of said assist device;

determining a set of dynamic torques for said assist device based on said static torques and said joint data;

generating torque data from said dynamic torques and said static torques; and applying said torque data to each said joint of said assist device.

16. The method of claim 15 further comprising the steps of:

measuring a joint position for each joint of said assist device;

measuring a joint velocity for each joint of said assist device;

computing a joint acceleration for each joint of said assist device; and calculating said dynamic torques from said static torques, joint positions, joint velocities, and joint accelerations.

17. The method of claim 16 further comprising the steps of:

modeling an inertial matrix based on compensated static torques; and modeling a partial differential inertial matrix based on said joint positions and joint velocities of said assist device.

18. The method of claim 17 wherein the joint accelerations are computed from the joint velocities and the partial differential inertial matrix.

19. The method of claim 15 further comprising the steps of:

formulating a Jacobian matrix for said assist device;

transposing said Jacobian matrix into a transposed Jacobian matrix; and multiplying said transposed Jacobian matrix by said force data.

20. The method of claim 19 wherein the Jacobian matrix is based on a joint position vector.

* * * * *